US005444598A

United States Patent [19]

Aresco

[11] Patent Number: 5,444,598

[45] Date of Patent: Aug. 22, 1995

[54] CAPACITOR EXPLODING FOIL INITIATOR DEVICE

[75] Inventor: Carmelo A. Aresco, Middletown, Conn.

[73] Assignee: Raymond Engineering Inc., Middletown, Conn.

[21] Appl. No.: 129,857

[22] Filed: Sep. 29, 1993

[51] Int. Cl.[6] ..... F23Q 23/00

[52] U.S. Cl. ..... 361/253; 102/209; 102/218

[58] Field of Search ..... 102/200, 206, 207, 209, 102/218, 221; 361/247, 248, 253, 254, 257, 251

[56] References Cited

U.S. PATENT DOCUMENTS 4,307,663 12/1981 Stonestrom .
4,422,381 12/1983 Barrett .
4,502,096 2/1985 Malone .
4,517,497 5/1985 Malone .
4,538,088 8/1985 Malone .
4,590,536 5/1986 Gerry ..... 361/253
4,592,280 6/1986 Shores .
4,602,565 7/1986 MacDonald et al. .
4,632,034 12/1986 Colle, Jr. .
4,662,281 5/1987 Wilhelm et al. .
4,716,832 1/1988 Sumner .
4,762,067 8/1988 Barker et al. .
5,088,413 2/1992 Huber et al. .
5,347,929 9/1994 Lerch et al. ..... 102/202.14

*Primary Examiner*—Jeffrey A. Gaffin
*Attorney, Agent, or Firm*—Fishman, Dionne & Cantor

[57] ABSTRACT

A capacitor exploding foil initiator device having a capacitor connected in parallel to a bleed resistor. The capacitor and resistor are connected across an exploding foil initiator by an over-voltage gap switch. When a voltage of the capacitor reaches a breakdown voltage of the switch, the energy stored in the capacitor is discharged through the switch to the exploding foil initiator.

15 Claims, 2 Drawing Sheets

CAPACITOR EXPLODING FOIL INITIATOR DEVICE

BACKGROUND OF THE INVENTION

The present invention relates generally to the field of explosives and more particularly to means, known as detonators, used to set off or detonate explosives. More particularly, the present invention relates to a capacitor exploding foil initiator device.

While explosives have long been used in various fields, their use is always subject to the dangers of premature explosion with resultant injury and damage. Explosives that produce the greatest force are likely to be explosives that are not easily detonated by heat or shock. To achieve the desired safety it is advisable to use explosives that are not likely to be unintentionally detonated by a rise in temperature or by a moderate shock. While such explosives are known, the characteristics that contribute to their safety also contribute to the difficulty of detonating them at the desired time. Thus, the detonation of such an explosive requires the use of some other explosive trigger means and the trigger means, in turn, must be one that is not subject to premature explosion. Many of these problems can be solved by the use of a less sensitive explosive such as HNS, (hexanitrostilbene) that, in turn, is detonated by means such as an exploding bridge.

It has long been known that the passage of an electric current through a conductor generates a certain amount of heat, the amount of heat varying directly with the resistance of the conductor and with the square of the current. This phenomenon is relied upon in fusible links that are installed in electrical circuits to prevent the flow of more than a predetermined amount of current in such a circuit. When the predetermined flow is exceeded, the heat melts the fusible link so that the circuit is broken. If a sufficient current is passed through the link in a small period of time, the link is not only melted but may be vaporized. If the fusible link is enclosed in a small space the vaporizing of the link can increase the pressure in that space.

For a number of years it has been customary to detonate an explosive by means of a blasting cap having a heat sensitive explosive set off by an electrical resistance heated by the passage of an electric current through the resistance. More recently, explosives have been detonated by means making use of a relatively high resistance bridge extending between conductors and through which a relatively high current is passed so that the bridge portion is not only heated to its melting point but is heated so much that it vaporizes and literally explodes to provide a shock wave to detonate the explosive. While such a system can use an explosive that is much less sensitive to heat and shock, there are still a distressing number of accidents that occur when an explosive is prematurely detonated. While less sensitive explosives have heretofore been available, it has been difficult to cause the detonation of such explosives at a selected time.

Recently, it has been proposed to detonate these more stable explosives by an electrical means of some sort that creates a sudden pressure to shear a film and form a disk or flyer which is then impacted against the explosive material.

In the construction of such a detonator, it is important that the explosive material be properly supported and sealed against the admission of materials such as moisture that would tend to deteriorate it. This is particularly important when the detonator is used in environments, such as deep wells, where the ambient pressures can become very high. It is also important that the physical construction be such that the flyer has sufficient kinetic energy imparted to it to insure the detonation of the explosive.

One such example is disclosed in U.S. Pat. No. 4,602,565 (which is incorporated herein by reference) wherein a detonator for a primary explosive uses a less sensitive secondary explosive that in turn is detonated by a flyer that is sheared from a sheet or film and propelled through a barrel to impact the secondary explosive. The flyer is sheared from the sheet by the pressure generated when an electrical conductor adjacent the sheet is vaporized by the sudden passage of a high current (as by the discharge of a capacitor) through it. The explosive is sealed against moisture, and the mechanical configuration of the detonator is such as to take full advantage of the kinetic energy of the flyer.

As is typical in the prior art, the capacitor is in a circuit with the foil detonator and a normally open switch. When it is desired to arm the system, the capacitor is charged, e.g., to 3000 volts; when it is desired to initiate the explosion, the switch is closed and the capacitor discharges through the foil vaporizing the same. A high resistance bleed resistor connected across the capacitor is used to bleed off the charge on the capacitor in the event that the latter is charged but then not discharged into the load.

SUMMARY OF THE INVENTION

The above-discussed and other problems and deficiencies of prior art are overcome or alleviated by the capacitor exploding foil initiator device of the present invention. In accordance with the present invention, the capacitor exploding foil initiator device comprises a low inductance capacitor connected in parallel to a bleed resistor. The capacitor and resistor are connected across an exploding foil initiator by an over-voltage gap switch. A high voltage (e.g., 3000 volts) is applied to the capacitor through a connector pin. When the voltage of the capacitor reaches the breakdown voltage of the switch, the energy stored in the capacitor is then discharged through the switch into the exploding foil initiator. The exploding foil initiator is preferably a flat polyimide substrate having copper-cladding with a pre-etched copper bridge dimension. The discharge of energy through the bridge results in a vaporization of the copper foil and a polyimide flyer is then accelerated toward a HNS explosive pellet (preferably HNS-IV). The velocity of the flyer propagates a shock wave through the HNS explosive which causes detonation. HNS requires a very high shock wave with a short time duration to cause detonation. This detonation, in turn, causes detonation of an explosive. The present invention also provides a low inductance interface for the transfer of energy with a minimum of losses in the system.

The above-discussed and other features and advantages of the present invention will be appreciated and understood by those of ordinary skill in the art from the following detailed discussion and drawings.

BRIEF DESCRIPTION OF THE DRAWINGS:

Referring now to the drawings, wherein like elements are numbered alike in the several FIGURES.

DESCRIPTION OF THE PREFERRED EMBODIMENT

Figure 1:
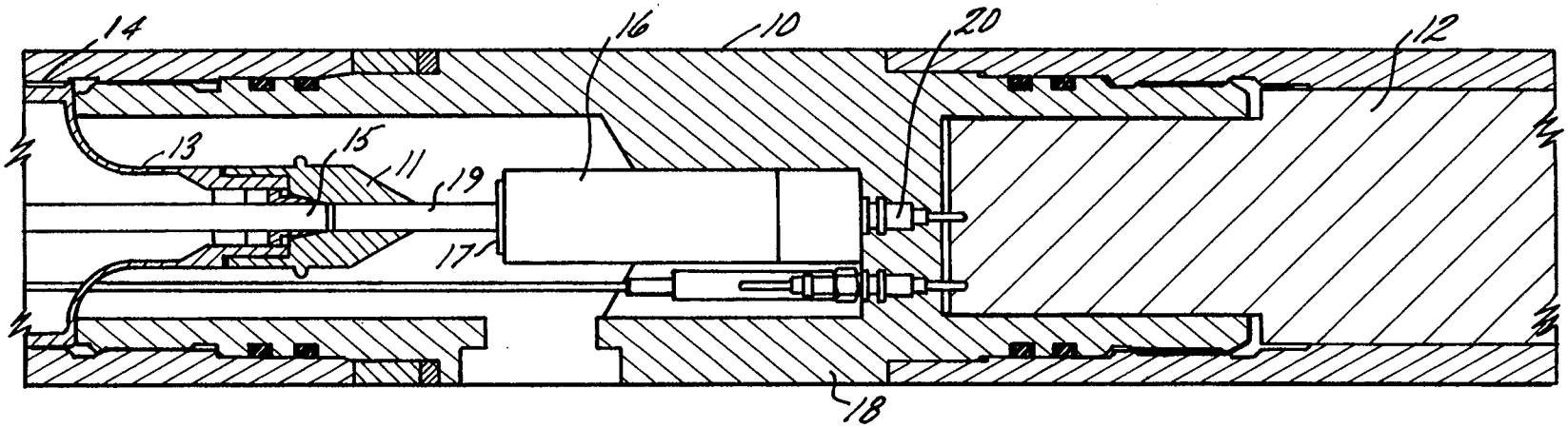
FIG. 1 is a cross section elevational view of an electronic safe and arm device employing a capacitor exploding foil initiator device in accordance with the present invention.

Referring to FIG. 1, a detonator device 10 is connected between a known type electronic safe and arm device 12 and a known type explosive assembly 14. Detonator device 10 comprises a capacitor exploding foil initiator device 16 disposed within a housing 18. Electrical connection between capacitor exploding foil initiator device 16 and electronic safe and arm device 12 comprises a pin 20.

Explosive assembly 14 includes a holding mount 11 and spring assembly 13 which secure a detonating cord 15 firmly against a surface 17 of capacitor exploding foil iniator device 16 for maintaining explosive propagation from capacitor exploding foil iniator device 16 to detonating cord 15. The tip or end of detonating cord 15 includes a booster charge 19 for proper ignition.

Figure 2:
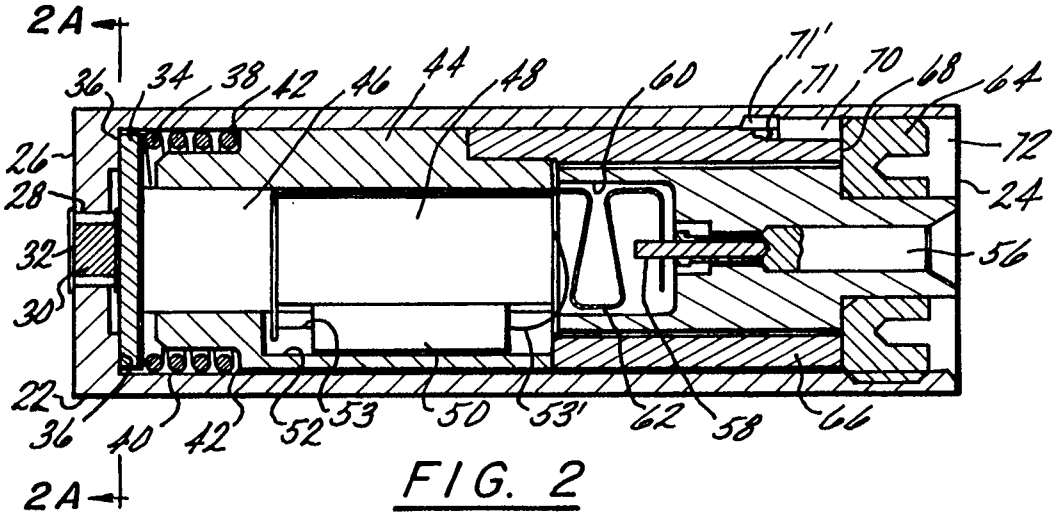
FIG. 2 is a cross section elevational view of the capacitor exploding foil initiator device of FIG. 1.

Referring to FIG. 2 capacitor exploding foil initiator device 16 comprises a generally cylindrical external housing 22 having an open end 24 and a partially closed end 26 with a central opening 28. A pellet assembly 30 is disposed in opening 28 with a disk 32 closing off opening 28. Pellet 30 is preferably a HNS (hexanitrostilbene) explosive pellet and more preferably a HNS-IV explosive pellet. A primed wiring board assembly 34 (i.e., an exploding foil initiator) is disposed within housing 22 and is supported on one side by a shoulder 36 of housing 22. The opposing side of assembly 34 is insulated by an insulating layer 38. Assembly 34 is biased against shoulder 36 by a spring 40 compressed between layer 38 and a shoulder 42 of an internal housing 44. Housing 44 is open at both ends thereof.

An over-voltage gap switch 46 is disposed within housing 44 at one end thereof adjacent insulating layer 38. Switch 46 may be of the type described in U.S. Pat. No. 4,538,088, which is incorporated herein by reference or any other suitable known switch which will make an electrical connection (i.e., switch closure) when a selected voltage (i.e., breakdown voltage) is attained. A capacitor 48 is disposed adjacent switch 46 within housing 44 at the other end thereof. Capacitor 48 is preferably a low-inductance capacitor capable of retaining a charge on the order of approximately 3000 volts, for example, the low-inductance capacitor described in U.S. Pat. No. 4,502,096, which is incorporated herein by reference. A bleed resistor 50 is mounted adjacent capacitor 48 within a recess 52 of housing 44. Resistor 50 includes leads 53 and 53' which electrically connect resistor 50 across capacitor 48. Lead 53' and the corresponding lead of capacitor 48 are in electrical contact with housing 44 which serves as case ground.

A contact assembly 54 is disposed at the open end 24 of housing 22. Assembly 54 includes a contact 56 (i.e., socket) for accepting pin 20 (described hereinbefore). A tab 58 extends from assembly 54 into a cavity 60 thereof. Tab 58 includes an eyelet wherein a conductive wire 62 is attached, preferably soldered. Wire 62 provides electrical connection between contact 56 and capacitor 48 (i.e., the corresponding lead of the capacitor connected to resistor lead 53).

A nut spanner 64 bears against a spacer 66 and a shoulder 68 of assembly 54 to secure the components in housing 22. A dowel pin 70 is disposed within recesses 71 and 71' of spacer 66 and housing 22 respectively to maintain alignment of these components. Spacer 66 bears against one end of housing 44 and is disposed about assembly 54. An opening in nut spanner 64 is filled with a compound 72 to seal the device and provide a flat outer surface.

Figure 3:
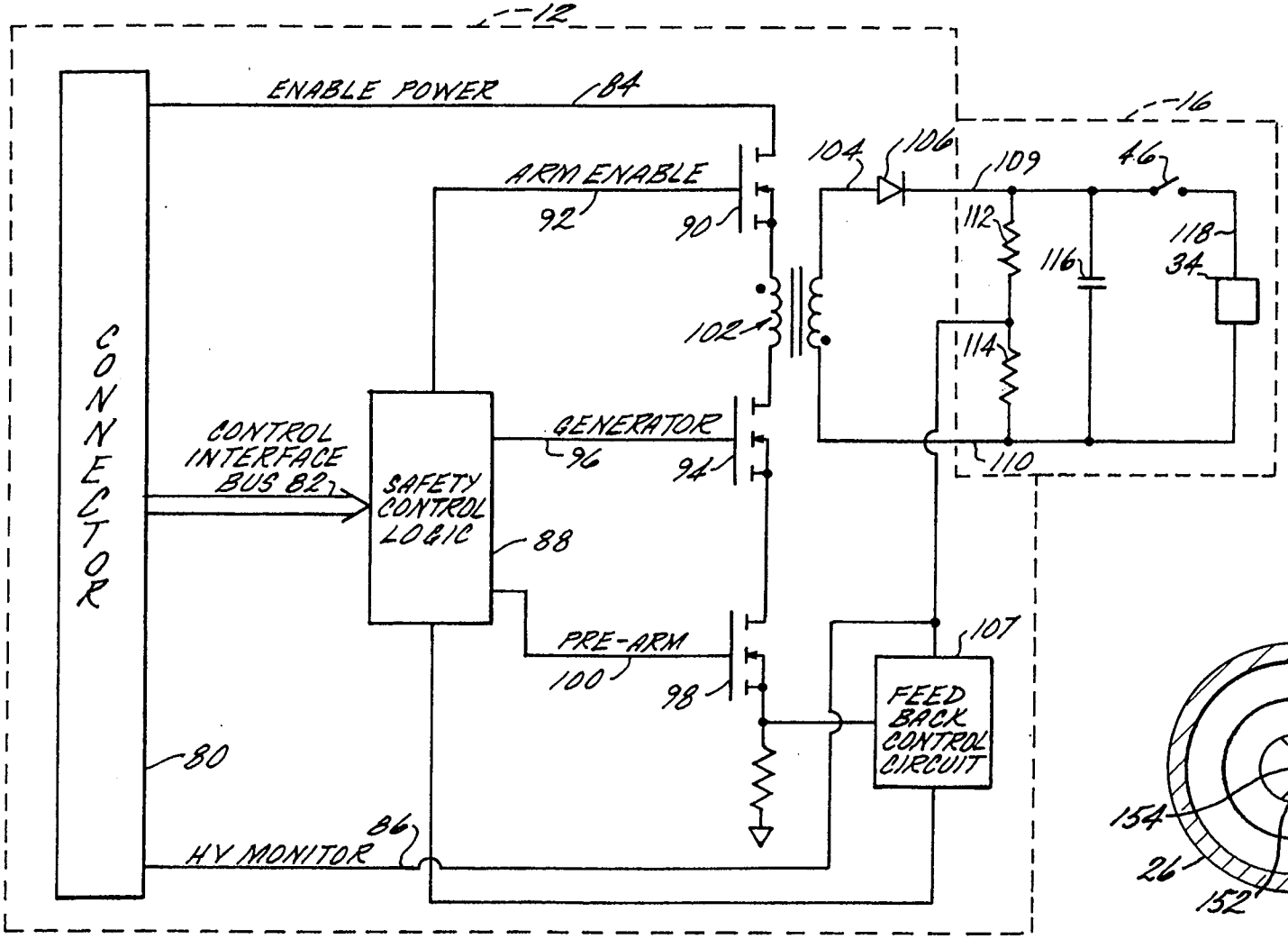
FIG. 3 is an electrical schematic diagram of the capacitor exploding foil initiator of FIG. 1.

Referring also to FIG. 3, wherein an electrical schematic of the electronic safe and arm device 12 and the capacitor exploding foil initiator device 16 are shown. A connector 80 provides interfacing for a control interface bus 82, an enable power line 84, and a high voltage monitor line 86. Bus 82 interfaces with a safety control logic circuit 88 which controls an arm enable transistor 90 over a line 92, a generator transistor 94 over a line 96, and a pre-arm transistor 98 over a line 100. All three transistors 90, 94 and 98 are required to be actuated before a high voltage signal is generated. The high voltage signal is generated by a flyback transformer 102 connected between transistors 90 and 94. The output voltage at a line 104 is rectified by a diode 106. A feed back control circuit 107 is connected between resistors 112, 114 and safety control logic circuit 88.

Figure 2A:
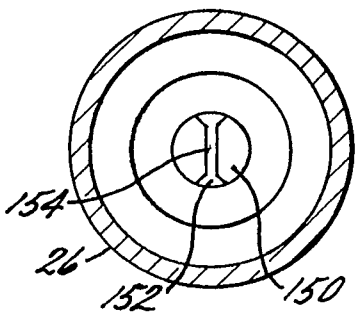
FIG. 2A is a cross sectional view through the line 2A—2A in FIG. 2.

A high voltage line 108 at the output of diode 106 and a case ground line 110 are connected to the parallel combination of resistor 50 and capacitor 48 in the capacitor exploding foil initiator device 16. One contact of switch 46 is also connected to capacitor 48 and resistor 50 by line 108. The other contact of switch 46 is connected to electronic foil initiator 34 by a line 118. Electronic foil initiator 34 is connected by line 110 to capacitor 48 and resistor 50. Also referring to FIG. 2A, electronic foil initiator 34 (i.e., printed wiring board) comprises a flat polyimide substrate (e.g., Dupont's Kapton ®) 150 having copper cladding 152 with a pre-etched copper bridge dimension 154. The copper bridge is electrically connected to switch 46 by line 118 and to case ground (line 110).

During use a high voltage (e.g., 3000 volts) is provided on line 108 from the electronic safe and arm device 12 through pin 20 to socket 56. The voltage at socket 56 is present at tab 58 and therefore on wire 62 which is connected to resistor 50 and capacitor 48. Flyback transformer 102 stores energy during the on time of the transistors. When the transistors are turned off the energy stored in the transformer is transferred to the output as load current. The result is that the load capacitor 48 is charged to a voltage determined by the transformer windings. Once the voltage of the capacitor reaches the breakdown voltage of the switch 46, the energy stored in the capacitor is then discharged from the switch into the copper bridge of electronic foil initiator 34. The discharge of energy through the bridge results in a vaporization of the copper foil generating a polyimide flyer which accelerates toward the explosive pellet 30. The velocity of the flyer propagates a shock wave through the explosive pellet which causes detonation thereof.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A capacitor exploding foil initiator device comprising:

a capacitor;

a resistor connected in parallel with said capacitor;

over-voltage gap switch means connected to said capacitor and resistor, said over-voltage gap switch means for providing switch closure when a breakdown voltage of said over-voltage gap switch means is obtained; and electronic foil initiator means connected to said over-voltage gap switch means and to said capacitor and resistor, said electronic foil initiator means for detonating an explosive.

2. The device of claim 1 wherein said capacitor is a low inductance capacitor.

3. The device of claim 1 wherein said electronic foil initiator means comprises:

a polyimide substrate;

a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

4. A capacitor exploding foil initiator device comprising:

a first housing having first and second opposing ends, said first end having an opening therethrough;

an explosive pellet disposed in said opening;

electronic foil initiator means disposed within said first housing at said first end near said explosive pellet, said electronic foil initiator means for detonating said explosive pellet;

a capacitor disposed within said first housing;

a resistor disposed within said first housing and electrically connected in parallel with said capacitor;

electrical contact means disposed at said second end of said first housing, said electrical contact means being receptive to an external electrical connection, said electrical contact means electrically connected to said capacitor and resistor; and over-voltage gap switch means disposed in said first housing and electrically connected to said capacitor and resistor and said electronic foil initiator means, said over-voltage of said over-voltage gap switch means for providing switch closure when a breakdown voltage of said over-voltage gap switch means is obtained.

5. The device of claim 4 further comprising:

a second housing disposed within said first housing, said capacitor, resistor and over-voltage gap switch means disposed within said second housing.

6. The device of claim 5 further comprising:

spring means disposed between said second housing and said electronic foil initiator means for maintaining said electronic foil initiator means near to said explosive pellet.

7. The device of claim 5 wherein said resistor is disposed adjacent to said capacitor with said resistor being disposed within a recess of said second housing, and said over-voltage gap switch being disposed adjacent said capacitor.

8. The device of claim 4 wherein said electrical contact means comprises:

a conductive wire having one end thereof connected to said capacitor and resistor; and a socket having means for attaching the other end of said wire thereto, said socket being receptive to the external electrical connection.

9. The device of claim 4 wherein said capacitor is a low inductance capacitor.

10. The device of claim 4 wherein said electronic foil initiator means comprises:

a polyimide substrate;

a layer of copper foil having a copper bridge dimension, said layer of copper foil being disposed on said polyimide substrate, whereby a discharge of sufficient energy through said copper bridge dimension results in a vaporization of said copper foil generating a flyer comprised of at least a portion of said polyimide substrate.

11. The device of claim 4 wherein said explosive pellet comprises hexanitrostilbene.

12. A method for detonating an explosive comprising the steps of:

charging a capacitor with a voltage;

discharging said capacitor through over-voltage gap switch means when the voltage of the capacitor reaches a breakdown voltage of said over-voltage gap switch means;

vaporizing a copper foil of a copper bridge dimension on a polyimide substrated with energy discharged from said capacitor through said over-voltage gap switch means, thereby generating a flyer comprised of at least a portion of said polyimide substrate; and accelerating said flyer toward an explosive pellet to generate a shock wave through said explosive pellet, thereby detonating said explosive pellet, wherein explosion of said explosive pellet detonates an explosive.

13. The method of claim 12 further comprising a resistor electrically connected in parallel with said capacitor.

14. The method of claim 12 wherein said capacitor is a low inductance capacitor.

15. The method of claim 12 wherein said explosive pellet comprises hexanitrostilbene.

* * * * *

UNITED STATES PATENT AND TRADEMARK OFFICE

CERTIFICATE OF CORRECTION

PATENT NO. : 5,444,598

DATED : August 22, 1995

INVENTOR(S) : Carmelo A. Aresco

It is certified that error appears in the above-indentified patent and that said Letters Patent is hereby corrected as shown below:

The title page, should be deleted to appear as per attached title page.

The sheet of drawings consisting of figure 3, should be deleted to appear as per attached sheet.

Signed and Sealed this

Twenty-sixth Day of December, 1995

*Attest:*

Bruce Lehman

BRUCE LEHMAN

*Attesting Officer*

*Commissioner of Patents and Trademarks*

United States Patent [19]

Aresco

[11] Patent Number: 5,444,598

[45] Date of Patent: Aug. 22, 1995

[54] CAPACITOR EXPLODING FOIL INITIATOR DEVICE

[75] Inventor: Carmelo A. Aresco, Middletown, Conn.

[73] Assignee: Raymond Engineering Inc., Middletown, Conn.

[21] Appl. No.: 129,857

[22] Filed: Sep. 29, 1993

[51] Int. Cl.[6] ..... F23Q 23/00

[52] U.S. Cl. ..... 361/253; 102/209; 102/218

[58] Field of Search ..... 102/200, 206, 207, 209, 102/218, 221; 361/247, 248, 253, 254, 257, 251

[56] References Cited

U.S. PATENT DOCUMENTS

| | | | |
|---|---|---|---|
| 4,307,663 | 12/1981 | Stonestrom . | |
| 4,422,381 | 12/1983 | Barrett . | |
| 4,502,096 | 2/1985 | Malone . | |
| 4,517,497 | 5/1985 | Malone . | |
| 4,538,088 | 8/1985 | Malone . | |
| 4,590,536 | 5/1986 | Gerry | 361/253 |
| 4,592,280 | 6/1986 | Shores . | |
| 4,602,565 | 7/1986 | MacDonald et al. . | |
| 4,632,034 | 12/1986 | Colle, Jr. . | |
| 4,662,281 | 5/1987 | Wilhelm et al. . | |
| 4,716,832 | 1/1988 | Sumner . | |
| 4,762,067 | 8/1988 | Barker et al. . | |
| 5,088,413 | 2/1992 | Huber et al. . | |
| 5,347,929 | 9/1994 | Lerch et al. | 102/202.14 |

*Primary Examiner*—Jeffrey A. Gaffin

*Attorney, Agent, or Firm*—Fishman, Dionne & Cantor

[57] ABSTRACT

A capacitor exploding foil initiator device having a capacitor connected in parallel to a bleed resistor. The capacitor and resistor are connected across an exploding foil initiator by an over-voltage gap switch. When a voltage of the capacitor reaches a breakdown voltage of the switch, the energy stored in the capacitor is discharged through the switch to the exploding foil initiator.

15 Claims, 2 Drawing Sheets

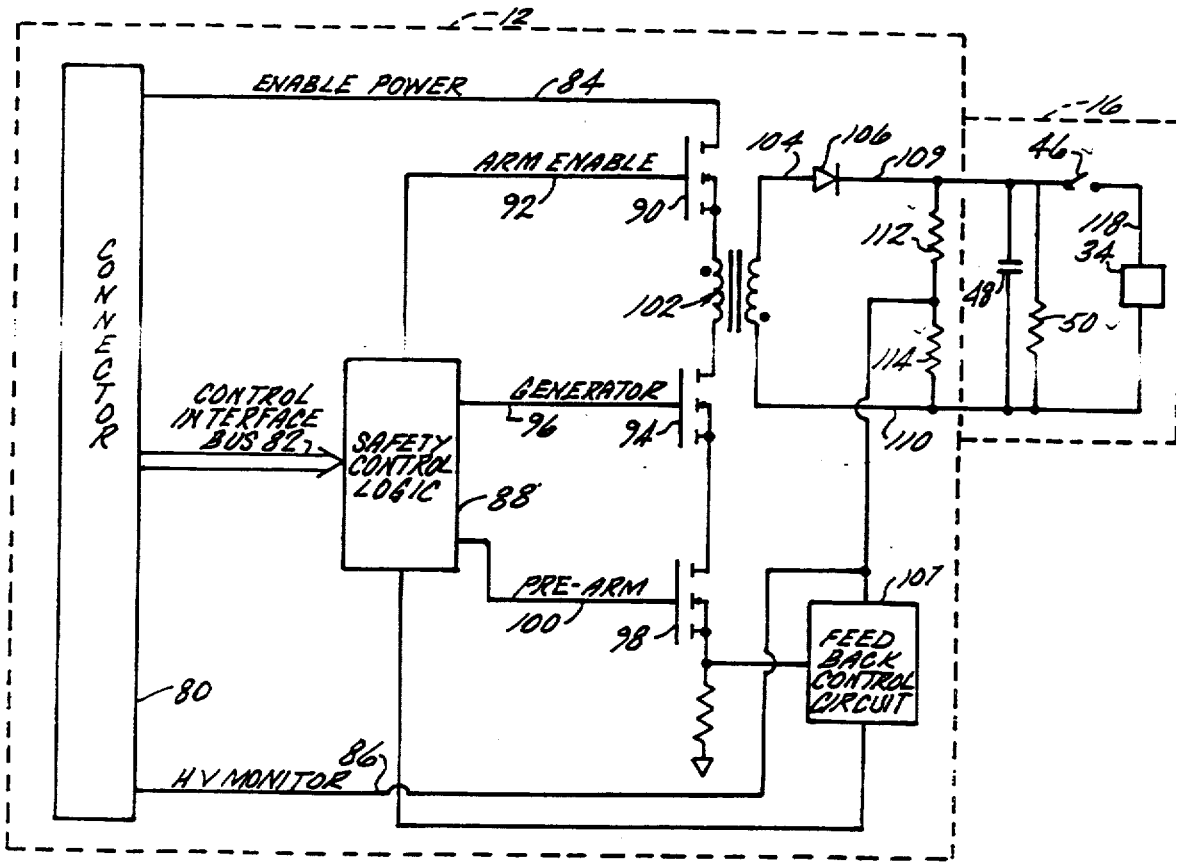

UNITED STATES PATENT AND TRADEMARK OFFICE
CERTIFICATE OF CORRECTION

PATENT NO. : 5,444,598

DATED : August 22, 1995

INVENTOR(S) : Carmelo A. Aresco

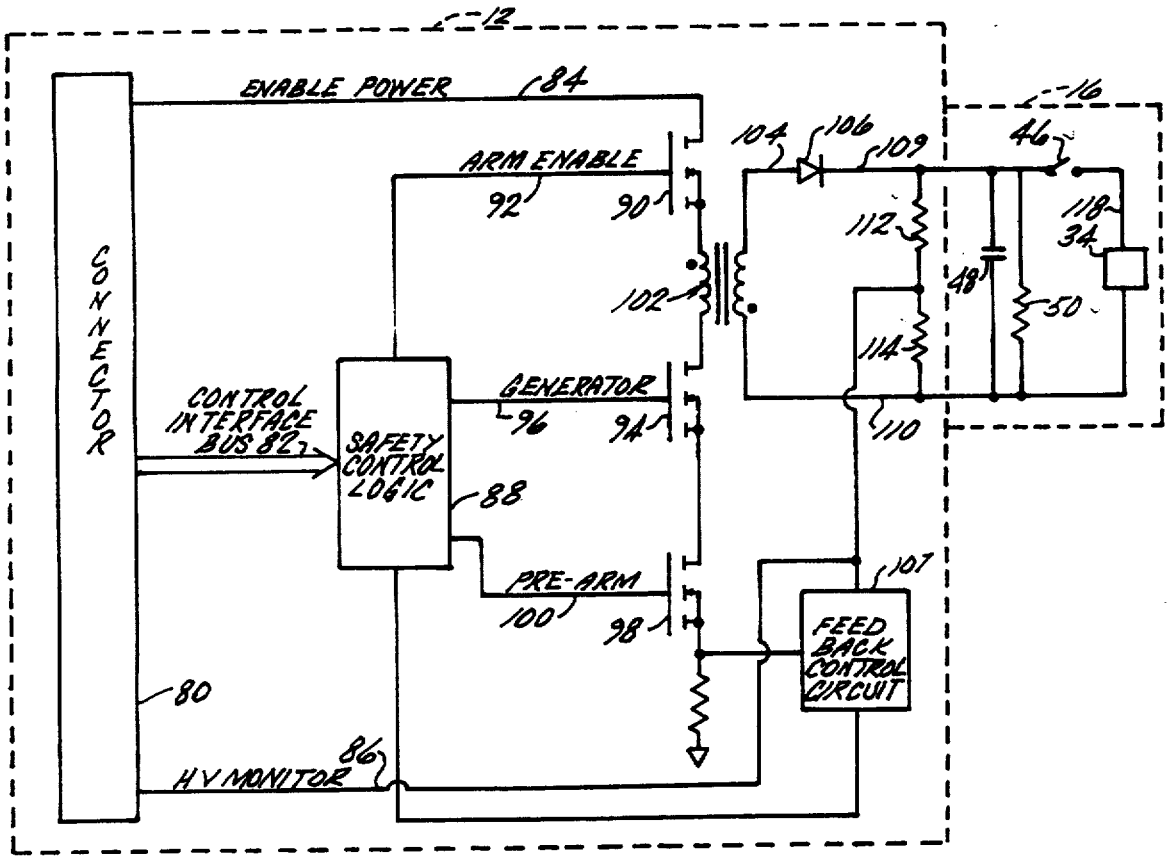

It is certified that error appears in the above-identified patent and that said Letters Patent is hereby corrected as shown below: